US008456407B2

(12) United States Patent
Weng et al.

(10) Patent No.: US 8,456,407 B2
(45) Date of Patent: Jun. 4, 2013

(54) DISPLAY CONTROLLING SYSTEM UTILIZING NON-IDENTICAL TRANSFER PULSE SIGNALS TO CONTROL DISPLAY AND CONTROLLING METHOD THEREOF

(75) Inventors: Meng-Tse Weng, Tainan County (TW); Chien-Ru Chen, Tainan County (TW)

(73) Assignee: Himax Technologies Limited, Fonghua Village, Xinshi Dist., Tainan (TW)

( * ) Notice: Subject to any disclaimer, the term of this patent is extended or adjusted under 35 U.S.C. 154(b) by 1094 days.

(21) Appl. No.: 12/418,621

(22) Filed: Apr. 6, 2009

(65) Prior Publication Data

US 2010/0253654 A1 Oct. 7, 2010

(51) Int. Cl.
*G09G 3/36* (2006.01)

(52) U.S. Cl.
USPC ..... 345/100; 315/98; 315/99

(58) Field of Classification Search
USPC ..... 345/76–82, 87–102, 211, 212, 204, 345/690; 315/87, 89, 98–100, 102, 690, 204, 315/691, 208, 213, 214
See application file for complete search history.

(56) References Cited

U.S. PATENT DOCUMENTS

| | | | | |
|---|---|---|---|---|
| 6,407,729 | B1 * | 6/2002 | Moon | 345/99 |
| 6,947,022 | B2 * | 9/2005 | McCartney | 345/99 |
| 7,079,105 | B2 * | 7/2006 | Katagawa | 345/99 |
| 2004/0189579 | A1 * | 9/2004 | Shimizu | 345/98 |

* cited by examiner

*Primary Examiner* — Duc Dinh
(74) *Attorney, Agent, or Firm* — Winston Hsu; Scott Margo

(57) ABSTRACT

A display controlling system utilized in a display, such as an LCD, includes a plurality of data lines and a plurality of source drivers. The source drivers receive a plurality of transfer pulse signals, each of which corresponds to one of the source drivers, and drive the corresponding data lines upon receiving the corresponding transfer pulse signal, wherein the transfer pulse signals are not all identical. The transfer pulse signal can be produced by the timing controller of the display, or the transfer pulse information required for generating the transfer pulse signals can be embedded in the source data to be delivered to the source drivers that generate the transfer pulse signals after obtaining the transfer pulse information. The transfer pulse signal lines between the timing controller and the source drivers can therefore be removed.

7 Claims, 7 Drawing Sheets

DISPLAY CONTROLLING SYSTEM UTILIZING NON-IDENTICAL TRANSFER PULSE SIGNALS TO CONTROL DISPLAY AND CONTROLLING METHOD THEREOF

BACKGROUND OF THE INVENTION

1. Field of the Invention

The present invention relates to a display, and more particularly, to a display and a method for controlling same.

2. Description of the Prior Art

Conventionally, a liquid crystal display (LCD) includes a plurality of source drivers, gate drivers, and a timing controller. The timing controller (TCON) is connected to the source drivers to transmit data and control timings. First the gate drivers output a gate signal to activate a gate line, and once the source drivers receive a transfer pulse signal TP from the timing controller, each of the source drivers drives its corresponding data lines, which means that corresponding display voltages are simultaneously supplied to a row of pixels corresponding to the activated gate line in the LCD.

However, there exists gate delays along the activated gate line, due to that each gate lines has parasitic resistors and parasitic capacitors. As can be seen from FIG. 1, corresponding to a first gate line during a first line period t1, the pixels near the gate drivers receive the gate signal with a shape like GS1*f*, but the pixels at the end of the first gate line receive the gate signal with a shape like GS1*e* due to the gate delay. After being filtered by the parasitic resistors and parasitic capacitors in the transmission path along the gate line, the shape of the gate signal significantly changes when it arrives at the last pixels in the gate line. Similarly, corresponding to a second gate line during the second line period t2, the pixels near the gate drivers receive the gate signal with a shape like GS2*f*, but the pixels at the end of the gate line receive the gate signal with a shape like GS2*e*. It can be seen at the beginning of the second line period t2 that the pixels of the second gate line receives the gate signal GS2 and thus activated, however, the ending pixels of the first gate line may be not fully turned off due to the shape of GS1*e*, therefore the image quality is affected.

To solve this problem, the pulse width of the gate signals needs to be shortened so that the last pixel in the gate line can be de-activated before the next transfer pulse signal. Shortening the pulse width of the gate signal, however, causes the problem that the charging time of the pixels is also shortened; the pixels may not have enough time to be charged to their target display voltage levels, especially when the panel is operated at high frequency.

SUMMARY OF THE INVENTION

One objective of the present invention is therefore to provide a display controlling system and a controlling method thereof that solve the above problems. The display controlling system utilizes a plurality of non-identical transfer pulse signals to control the display rather than utilizing one single transfer pulse signal. Each source driver is provided with a dedicated transfer pulse signal, and therefore the gate signal does not need to be shortened. Since the pulse width of the gate signal can be increased, the present invention is suitable for a high-frequency operation environment.

Moreover, the transfer pulse information required for generating the transfer pulse signals can be embedded in the source data. The source drivers generate the transfer pulse signals after receiving the source data. In this way, the transfer pulse signal lines between the timing controller and the source drivers can be removed to save production cost.

According to one exemplary embodiment of the present invention, a display controlling method utilized in a display is disclosed. The display comprises a plurality of source drivers and a plurality of data lines, and the display controlling method comprises receiving a plurality of transfer pulse signals, each of the transfer pulse signal corresponding to one of the source drivers, wherein the transfer pulse signals are not all identical, and driving the corresponding data lines by the corresponding source driver upon receiving the corresponding transfer pulse signal.

According to another exemplary embodiment of the present invention, a display controlling system utilized in a display is disclosed. The display controlling system comprises a plurality of data lines, and a plurality of source drivers. The source drivers receive a plurality of transfer pulse signals, each of which corresponds to one of the source drivers, and drive the corresponding data lines upon receiving the corresponding transfer pulse signal, wherein the transfer pulse signals are not all identical.

According to another exemplary embodiment of the present invention, a display controlling system utilized in a display is disclosed. The display controlling system comprises a plurality of data lines, a plurality of source drivers, and a timing controller, coupled to the source drivers, for generating a plurality of transfer pulse signals, each of which corresponds to one of the source drivers, wherein the transfer pulse signals are not all identical. The timing controller delivers the transfer pulse signals to the source drivers, which respectively drive corresponding data lines upon receiving the corresponding transfer pulse signal.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is coupled to another device, that connection may be through a direct electrical connection, or through an indirect electrical connection via other devices and connections.

Figure 1:
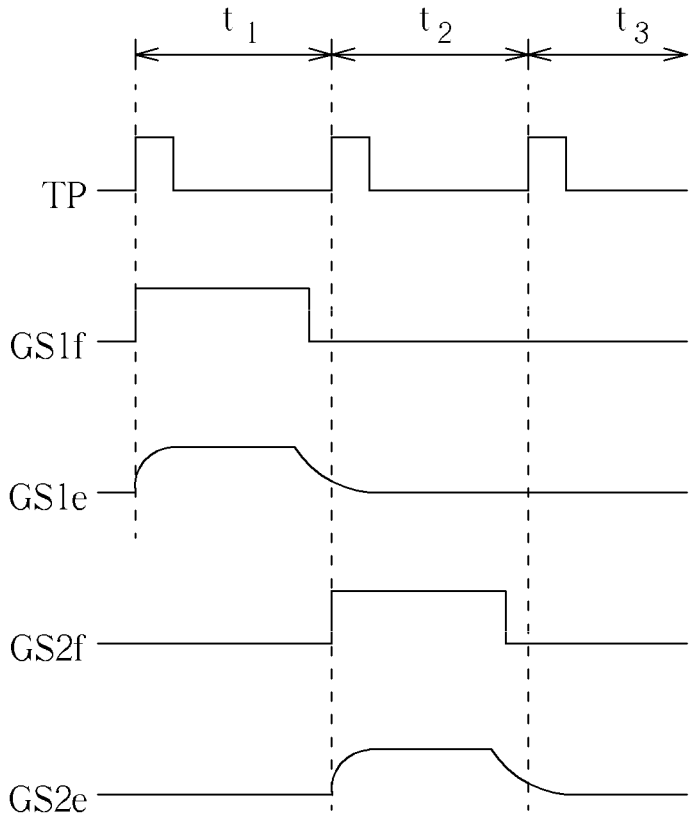
FIG. 1 is a diagram showing the relationship between the conventional transfer pulse signal and gate signals.
Figure 2:
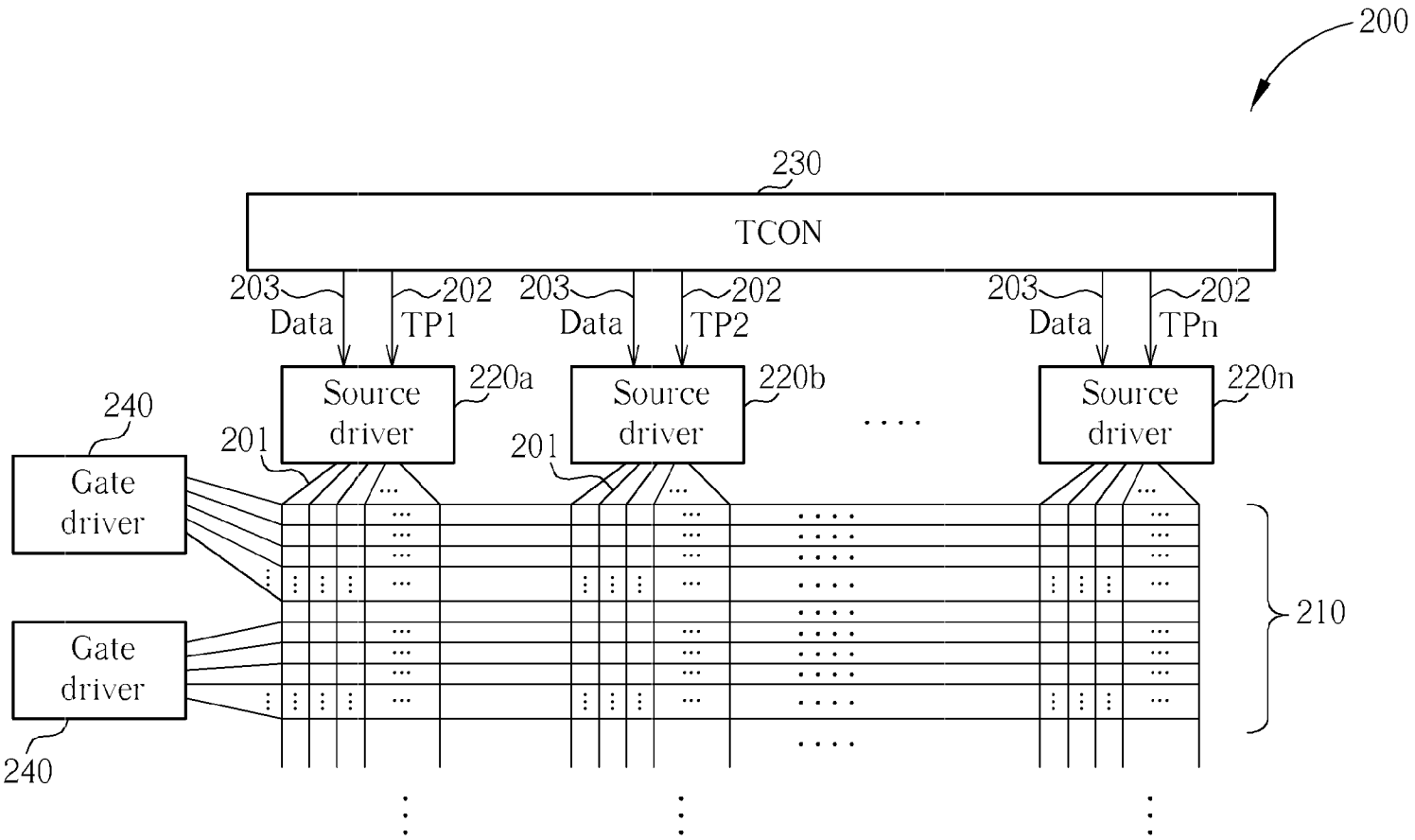
FIG. 2 is a diagram of a display controlling system utilized in a display according to one exemplary embodiment of the present invention.

FIG. 2 illustrate a diagram of a display 200. The display 200 comprises a panel 210, a plurality of source drivers 220, gate drivers 240 and a timing controller (TCON) 230. The timing controller 230 generates plural transfer pulse signals TP respectively for the source drivers 220. For example, the source driver 220*a* corresponds to the transfer pulse signal TP1; the source driver 220*b* corresponds to the transfer pulse signal TP2; the source driver 220*n* corresponds to the transfer pulse signal TPn. The source drivers each drives the corresponding data lines 201 upon receiving the corresponding transfer pulse signal. The difference is that, where the prior art uses a single transfer pulse signal for all source drivers, the display 200 utilizes a plurality of transfer pulse signals TP1, TP2, . . . , TPn that are not all identical.

Figure 3:
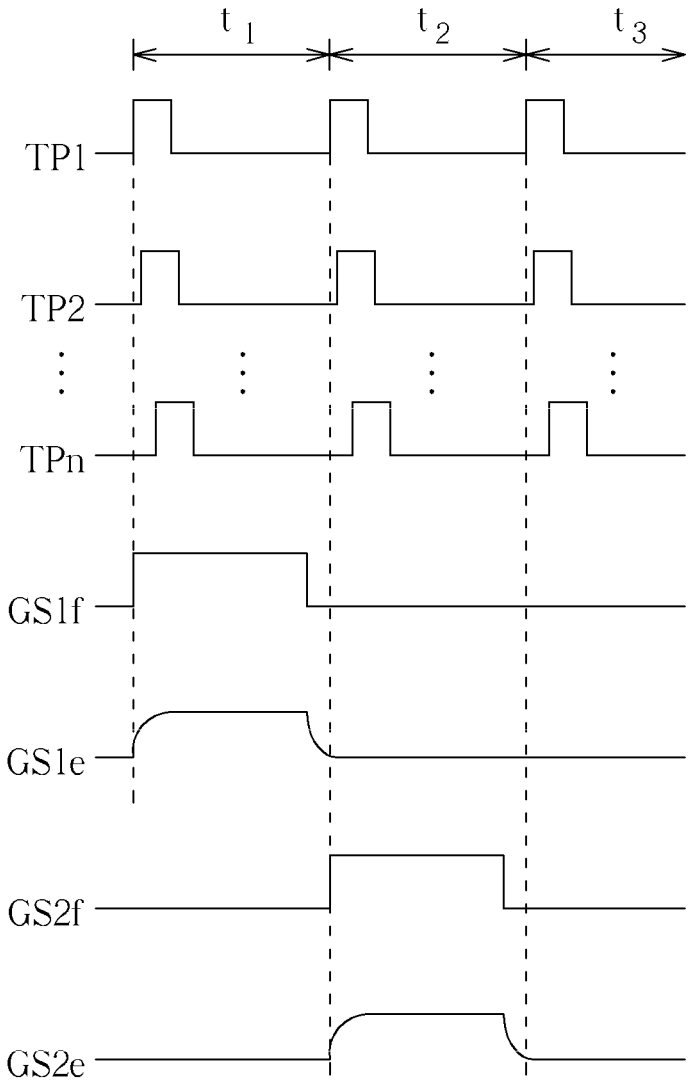
FIG. 3 is a diagram showing the relationship between the transfer pulse signals and gate signals according to one exemplary embodiment of the present invention.

FIG. 3 is a timing diagram of the transfer pulse signals TP1, TP2, . . . , and TPn, and gate signals according to one exemplary embodiment of the present invention. In this embodiment, the transfer pulse signal TP2 is a delayed signal of transfer pulse signal TP1, the transfer pulse signal TP3 is a delayed signal of transfer pulse signal TP2, and so on. Therefore, the timing of each source driver 220 driving corresponding data lines 201 is not identical. During a first line period t1, the transfer pulse signal TP1 is asserted, the gate signal GS1 for the first gate line is activated, and the source drivers 220*a*-220*n* sequentially output the display voltages to drive the display respectively based on the transfer pulse signals TP1-TPn. That is, the timing when the source driver 220*b* loads the display voltages to the data lines is later than the timing when the source driver 220*a* loads the display voltage, and the timing at which the source driver 220*n* loads the display voltage to the data lines is the latest. Since the transfer pulse signals TP2, . . . , TPn are delayed, the last pixels, driven according to TPn, receive the distorted gate signal GS1*e* and can be turned off in time before the next TPn, i.e. before the source driver 220*n* loads the next display voltage to the pixels corresponding to the next gate line, thereby the image quality can be improved.

Moreover, by applying the above concept of having non-identical transfer pulse signals, the pulse width of the gate signals can be increased, and therefore the charging time of the pixels is lengthened. This property makes the display 200 suitable for high-frequency operation when implemented with a high-frequency panel or a heavy-loading panel.

The generation of the transfer pulse signals can be performed by the timing controller 230 or the source drivers 220. In one embodiment, the timing controller 230 generates the non-identical transfer pulse signals, and then sends them to the corresponding source drivers 220 through the transfer pulse signal lines 202. The timing controller 230 may derive the transfer pulse signals according to one specific signal, such as the transfer pulse signal TP1. For example, the timing controller 230 first generates the transfer pulse signal TP1, and then delays it to generate the other transfer pulse signals.

In addition, widths and phase delays of the transfer pulse signal TP1-TPn can be determined in a system level. For example, assuming that there are six source drivers and the six source drivers sequentially output the display voltages to drive the display respectively based on the transfer pulse signals TP1-TP6, the widths of the transfer pulse signal TP1-TP6 can be determined as follows: TP1 width: A1*Wunit;

TP2 width: A2*Wunit;
TP3 width: A3*Wunit;
TP4 width: A4*Wunit;
TP5 width: A5*Wunit;
TP6 width: A6*Wunit;

where $0 \leqq A1 \leqq A2 \leqq A3 \leqq A4 \leqq A5 \leqq A6 \leqq 2^m$, m is an integer and Wunit is determined in the system level. The phase delays of the transfer pulse signal TP1-TP6 can be determined as follows:

TP1 phase delay: B1*Δt;
TP2 phase delay: B2*Δt;
TP3 phase delay: B3*Δt;
TP4 phase delay: B4*Δt;
TP5 phase delay: B5*Δt;
TP6 phase delay: B6*Δt;

where $0 \leqq B1 \leqq B2 \leqq B3 \leqq B4 \leqq B5 \leqq B6 \leqq 2^n$, n is an integer, $\Delta t = T/2^n$, and T is determined in the system level.

Furthermore, in other embodiment, phase delays of the transfer pulse signal TP1-TP6 can also be independently determined by the timing controller 230, that is:

TP1 phase delay: Δt1;
TP2 phase delay: Δt2;
TP3 phase delay: Δt3;
TP4 phase delay: Δt4;
TP5 phase delay: Δt5;
TP6 phase delay: Δt6;

where $0 \leqq \Delta t1 \leqq \Delta t2 \leqq \Delta t3 \leqq \Delta t4 \leqq \Delta t5 \leqq \Delta t6$.

Figure 4A:
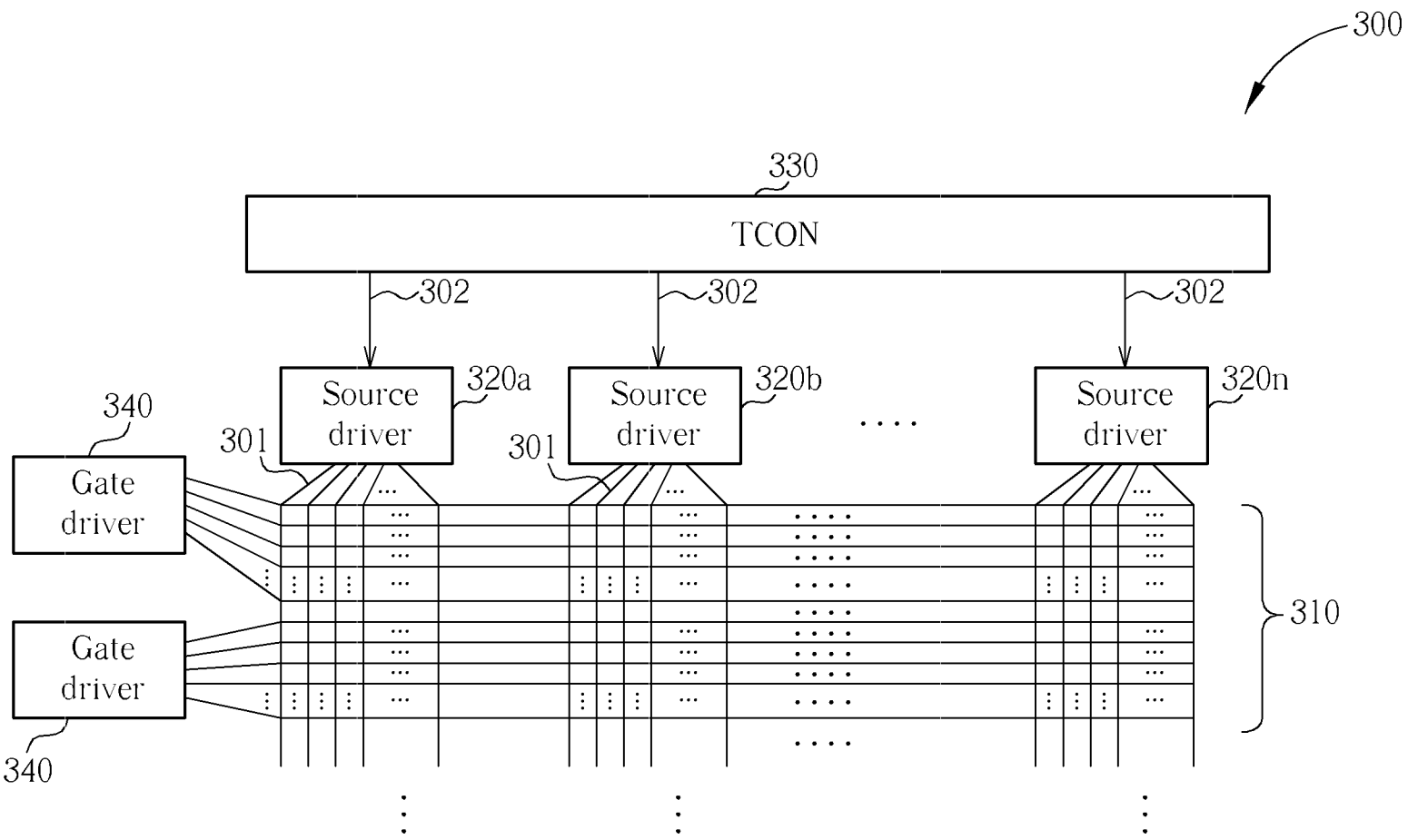
FIG. 4A is a diagram of a display controlling system utilized in a display according to another exemplary embodiment of the present invention.
Figure 4B:
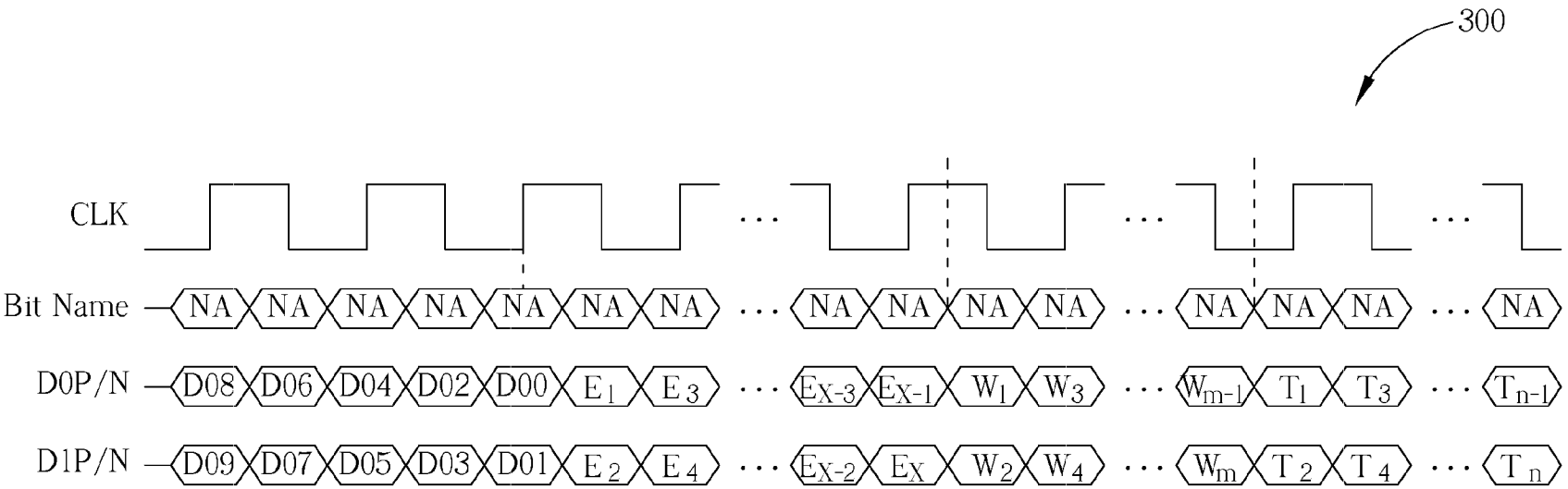
FIG. 4B is a diagram illustrating transfer pulse information.

FIG. 4A illustrate a diagram of a display 300. The display 300 comprises a panel 310, a plurality of source drivers 320, gate drivers 340 and a timing controller (TCON) 330. The display 300 is similar to the display 200 shown in FIG. 2 except the transfer pulse signal lines. In the display 300, the timing controller 330 embeds transfer pulse information, which is used for generating the transfer pulse signals, in the data received by the source drivers 320 through the data lines 302. The source drivers 320 generate the transfer pulse signals after receiving the source data (e.g. D00-D09 as shown in FIG. 4B). In FIG. 4B, the transfer pulse information is transmitted on the data lines 302 and includes delay time information carried by the data T1-Tn and/or pulse width information carried by the data W1-Wm for generating the transfer pulse signals. Further, appended to the source data, and a protection sequence, such as a predefined sequence (such as the data E1-Ex shown in FIG. 4B), can be added between the source data and the transfer pulse information in order to enable the source drivers 320 correctly determine the end of the source data and the beginning of the transfer pulse information. Therefore, after the source drivers 320 determine that the source data is ended, a clock in the source drivers 320 samples the protection sequence and the following sequence containing the transfer pulse information. When the transfer pulse information is obtained, the transfer pulse signals can be produced. In this way, the transfer pulse signal lines 302 between the timing controller 330 and the source driver can be removed to save production cost and prevent errors happening to the transfer pulse signal lines 302. In addition, in FIG. 4B, the source data, the delay time information and the pulse width information are transmitted via two data lines D0P/N and D1P/N. However, in other embodiment of the present invention, the source data, the delay time information and the pulse width information can be transmitted in a single data line, these alternative designs falls in the scope of the present invention.

For the displays 200 and 300, each transfer pulse signal can be represented by a sequence of transfer pulse information, and each source driver 220 (or 330) only receives the corresponding sequence to generate the corresponding transfer pulse signal. In another embodiment, the transfer pulse information of every transfer pulse signal is packed together and sent to every source driver 220 (or 330). The source drivers 220 (or 330), however, only extract the corresponding part of the transfer pulse information to generate the corresponding transfer pulse signal.

In another embodiment, the source drivers 220 derive the transfer pulse signals based on a specific signal, wherein the specific signal is received from the timing controller 230 or embedded in the source data. The source drivers 220 may extract the information required for producing the specific signal from the source data, generate the specific signal according to the information, and then delay or adjust the pulse width of the specific signal to generate the transfer pulse signals. Both the delay time information for delaying the specific signal and the pulse width information for adjusting the pulse width of the specific signal can also be embedded in source data by the timing controller 230. The delay time and the pulse width of each transfer pulse signal are not limited; they depend on the system requirements.

Figure 5:
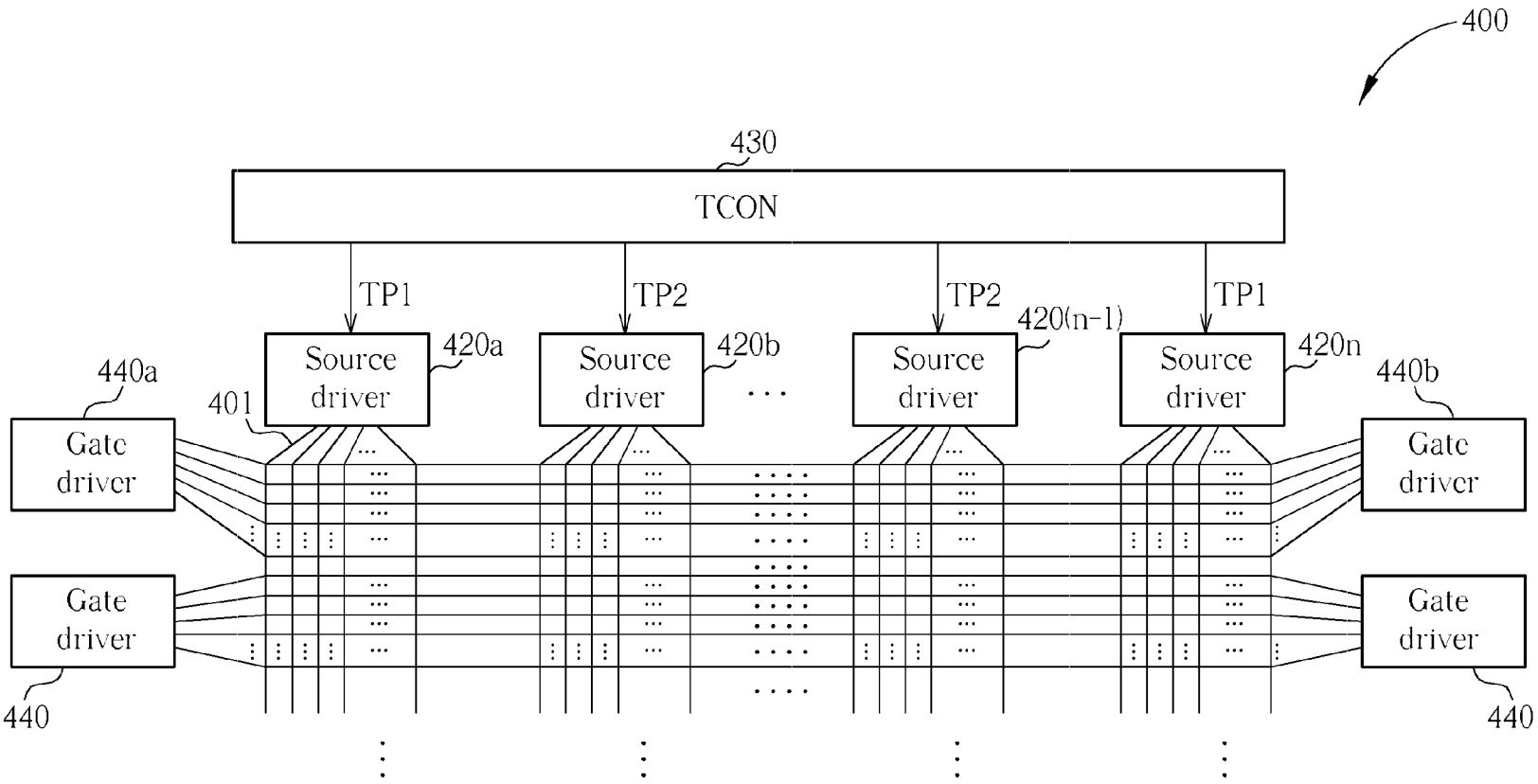
FIG. 5 is a diagram of a display controlling system utilized in a display according to another exemplary embodiment of the present invention.

When the display controlling system is implemented in a bi-directional driving display device, the source drivers and the transfer pulse signals can be arranged as shown in FIG. 5. The source drivers 420 are divided into two groups (left group and right group in this embodiment) and the transfer pulse signals are correspondingly divided into two groups. One transfer pulse signal in the first group is identical to one transfer pulse signal in the second group, wherein the transfer pulse signals in the first group are not identical, and the transfer pulse signals in the second group are not identical. In this embodiment, the source driver 420*a* and source driver 420*n* both control the corresponding data lines according to the transfer pulse signal TP1, while the source driver 420*b* and source driver 420(*n*-1) both control the corresponding data lines according to the transfer pulse signal TP2, and so forth. This is because the gate driver 440*a* is synchronized to the gate driver 440*b*, therefore the fading of the gate signal occurs gradually from the outer portion to the inner portion.

Figure 6:
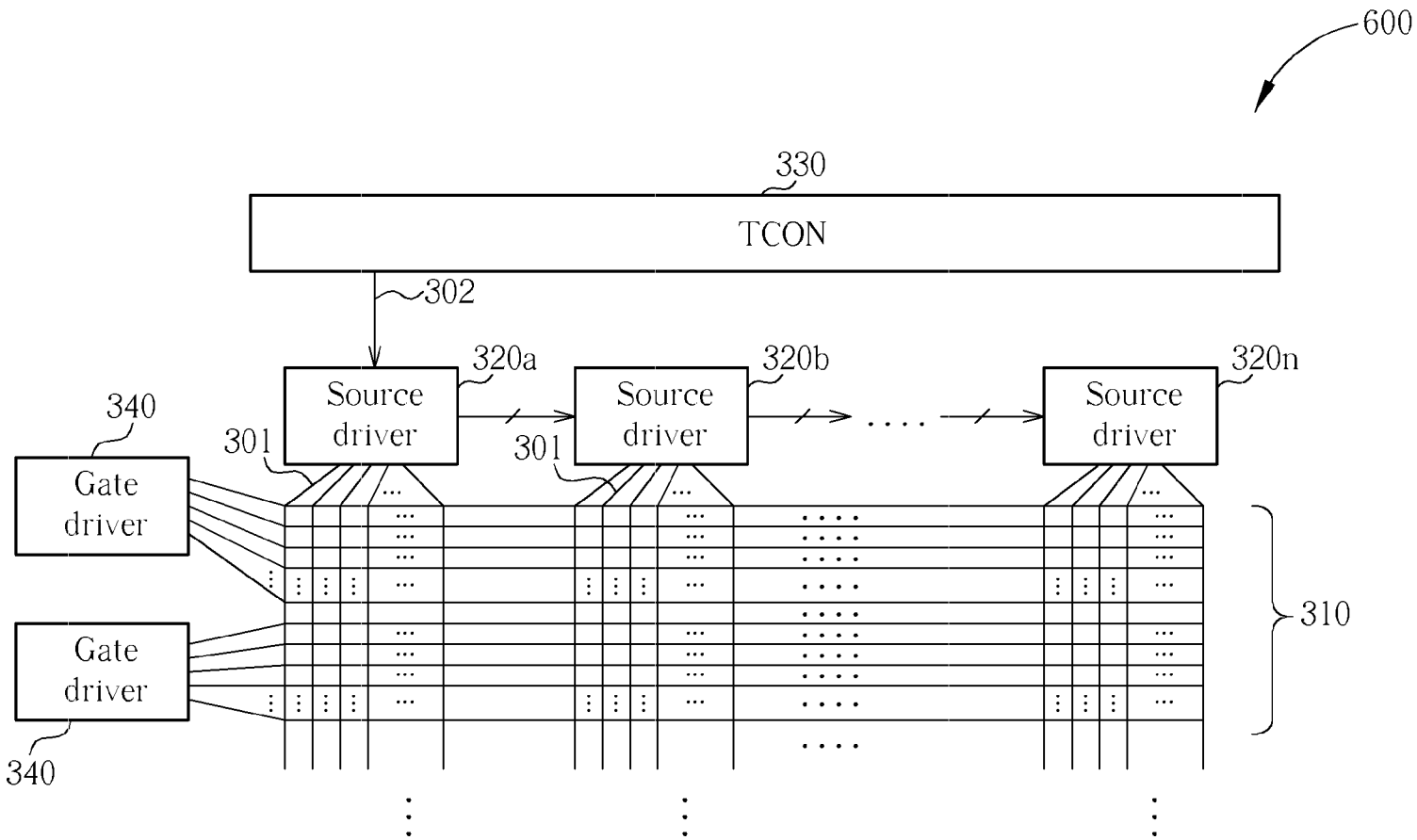
FIG. 6 is a diagram of a display controlling system utilized in a display according to another exemplary embodiment of the present invention.

Please refer to FIG. 6. FIG. 6 is a diagram illustrating a display 600. The display 600 is similar to the display 300 shown in FIG. 4A, and the difference between the displays 600 and 300 is that: in the display 600, each of the source drivers 320*b*-320*n* receives the source data from the timing controller 330 via at least one previous source drivers 320*a*-320(*n*-1) rather than directly receiving the source data from the timing controller 330 shown in FIG. 4A. In addition, the other operations of the display 600 are the same as the display 300, and further descriptions are omitted here.

As the display controlling systems 200 and 400 utilize non-identical transfer pulse signals to control the display rather than utilizing one single transfer pulse signal, the gate signal does not need to be shortened in order to maintain the accuracy of voltage loading, and therefore the problems met by the prior arts are solved. Since the pulse width of the gate signal can be increased, the present invention is suitable for a high-frequency operation environment.

Those skilled in the art will readily observe that numerous modifications and alterations of the device and method may be made while retaining the teachings of the invention.

What is claimed is:

1. A display controlling method utilized in a display, wherein the display comprises a plurality of source drivers and a plurality of data lines, the display controlling method comprising:

receiving source data embedded with transfer pulse information from a timing controller via at least one line, wherein the source data and the transfer pulse information are transmitted on the same line;

producing a plurality of transfer pulse signals according to the transfer pulse information, wherein the transfer pulse signals correspond to source drivers, respectively, and the transfer pulse signals are not all identical;

receiving the transfer pulse signals respectively corresponding to the source drivers;

utilizing the source data to drive the corresponding data lines by the corresponding source driver upon receiving the corresponding transfer pulse signal, wherein the source drivers are divided into two groups and the transfer pulse signals are correspondingly divided into two groups, one transfer pulse signal in the first group is identical to one transfer pulse signal in the second group, the transfer pulse signals in the first group are not identical, and the transfer pulse signals in the second group are not identical.

2. The display controlling method of claim 1, wherein the producing step is performed by the source drivers.

3. A display controlling system utilized in a display, comprising:

a plurality of data lines; and a plurality of source drivers, for receiving a plurality of transfer pulse signals, each of the transfer pulse signals corresponding to one of the source drivers, and driving the corresponding data lines upon receiving the corresponding transfer pulse signal, wherein the transfer pulse signals are not all identical;

wherein the source drivers receive source data embedded with transfer pulse information via at least one line, where the source data and the transfer pulse information are transmitted on the same line, and produces the transfer pulse signals according to the transfer pulse information, wherein the source drivers are divided into two groups and the transfer pulse signals are correspondingly divided into two groups, one transfer pulse signal in the first group is identical to one transfer pulse signal in the second group, the transfer pulse signals in the first group are not identical, and the transfer pulse signals in the second group are not identical.

4. The display controlling system of claim 3, further comprising a timing controller, coupled to the source driver, for embedding the transfer pulse information in the source data, and transmitting the source data to the source drivers.

5. A display controlling method utilized in a display, wherein the display comprises a plurality of source drivers and a plurality of data lines, the display controlling method comprising:

receiving source data embedded with delay time information or pulse width information from a timing controller via at least one line, wherein the source data and the delay time information or pulse width information are transmitted on the same line;

receiving a specific signal;

deriving a plurality of transfer pulse signals based on the specific signal and the delay time information, or based on the specific signal and pulse width information, wherein the transfer pulse signals correspond to the source drivers, respectively, and the transfer pulse signals are not all identical;

receiving the transfer pulse signals respectively corresponding to the source drivers;

utilizing the source data to drive the corresponding data lines by the corresponding source driver upon receiving the corresponding transfer pulse signal, wherein the source drivers are divided into two groups and the transfer pulse signals are correspondingly divided into two groups, one transfer pulse signal in the first group is identical to one transfer pulse signal in the second group, the transfer pulse signals in the first group are not identical, and the transfer pulse signals in the second group are not identical.

6. The display controlling method of claim 5, wherein the deriving step is performed by delaying the specific signal by using the delay time information.

7. The display controlling method of claim 5, wherein the deriving step is performed by adjusting a pulse width of the specific signal by using the pulse width information.

* * * * *